United States Patent [19]
Vrcic
[11] 4,317,571
[45] Mar. 2, 1982

[54] BAT AND PROJECTILE GAME

[76] Inventor: Nicholas Vrcic, 1493 Daleland Ave., Pittsburgh, Pa. 15220

[21] Appl. No.: 196,347

[22] Filed: Oct. 14, 1980

[51] Int. Cl.[3] ..... A63B 67/00
[52] U.S. Cl. ..... 273/341
[58] Field of Search ..... 273/341, 407; 248/DIG. 10

[56] References Cited

U.S. PATENT DOCUMENTS

| | | | |
|---|---|---|---|
| 1,935,370 | 11/1933 | Nekuda | 273/341 |
| 2,122,505 | 7/1938 | Yon | 273/341 |
| 2,993,696 | 7/1961 | Demaline | 273/341 X |
| 3,232,618 | 2/1966 | Anderson, Sr. | 273/341 |
| 3,817,525 | 6/1974 | Henry | 273/341 |
| 3,957,270 | 5/1976 | Fekete | 273/341 |
| 4,052,065 | 10/1977 | Rodriquez | 273/341 |
| 4,109,910 | 8/1978 | Gleason | 248/DIG. 10 X |
| 4,149,724 | 4/1979 | Walsh | 273/341 |
| 4,183,532 | 1/1980 | Iglesias | 273/341 |

*Primary Examiner*—William H. Grieb
*Attorney, Agent, or Firm*—Reed, Smith, Shaw & McClay

[57] ABSTRACT

A game wherein a projectile (10) is placed in groove (26) of a base (20) and then launched upwardly by striking the exposed portion of projectile (10) with bat (16).

7 Claims, 4 Drawing Figures

BAT AND PROJECTILE GAME

BACKGROUND OF THE INVENTION

1. Field of the Invention

The subject invention relates to games; more particularly, action games requiring projecting an object by striking it with a bat or club.

2. Description of the Prior Art

In the prior art, various games have been developed in which a projectile is struck with a bat or club to accomplish various purposes, such as to carry the projectile toward a target. Examples are illustrated in U.S. Pat. Nos. 1,935,370; 2,122,505; 2,993,696; and 3,957,270. Various modifications have been made to these games such as providing bases that support the projectile in various fashions, such as with springs, cylinders, ramps and blocks. U.S. Pat. Nos. 3,232,618; 3,817,525; 4,052,065; and 4,149,724 are generally illustrative of such support mechanisms.

However, such supports were found to be objectionable because they were not sufficiently stable so as to firmly support the projectile and also permit its unobstructed movement in a given line of trajectory away from the base. Further, such bases tended to overturn, delaying progress of the game. Accordingly, there was a need for a stable base for supporting the projectile such that they will have a predictable trajectory away from the base and the base remains in an upright position.

SUMMARY OF THE INVENTION

In accordance with the subject invention, a game is provided in which a projectile supported on a base is struck twice with a bat; first, to launch the projectile above the base and again to drive the projectile laterally away from the location of the base. The base includes a groove in which the projectile is supported underneath by an inclined bottom surface, and on the end by an end stop. The bottom surface and end stop of the groove intersect at an obtuse angle with the depth of the groove at the intersection being not more than one-half the length of the groove along the top surface of the base.

Preferably, the base includes a lower, foot portion and an upper arm portion in which the groove is located. Preferably, the foot portion is hollow and has a hole in the bottom surface so that it can be filled with a dense material such as sand or water to increase the stability of the base.

Most preferably, the height of the arm portion is greater than the height of the foot portion.

Other details, object and advantages of the subject invention will become apparent as the following description of a presently preferred embodiment thereof proceeds.

BRIEF DESCRIPTION OF THE DRAWINGS

The accompanying drawings show a presently preferred embodiment of the invention in which.

DESCRIPTION OF THE PREFERRED EMBODIMENT

Figure 1:
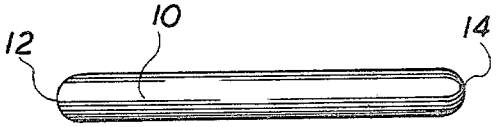
FIGS. 1 and 2 are, respectively, projections of a projectile and a bat suitable for use in the presently disclosed game.

FIGS. 1–4 show the preferred embodiment of the projectile, bat and base that comprise the subject invention. As shown in FIG. 1, the projectile (10) has a generally longitudinal shape. Preferably, projectile (10) is tubular in shape and has a length that is in the range of 4 to 8 times its diameter. Also preferably, projectile (10) is closed at each end with hemispherical surfaces (12 and 14).

Figure 2:
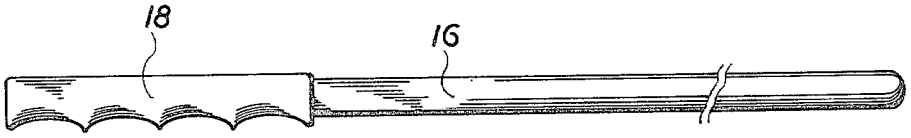

As shown in FIG. 2, a bat (16) is also included for striking projectile (10) as hereinafter more fully explained. Preferably, bat (16) is of a generally circular cross-section and is provided with a handle grip (18).

Figure 3:
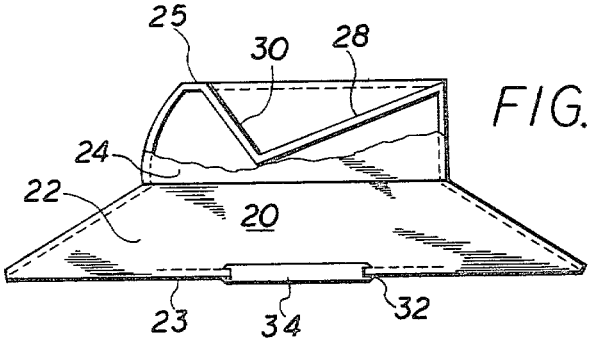
FIGS. 3 and 4 are front and plan views of the base disclosed herein with portions of FIG. 3 broken away to better disclose the details thereof.
Figure 4:
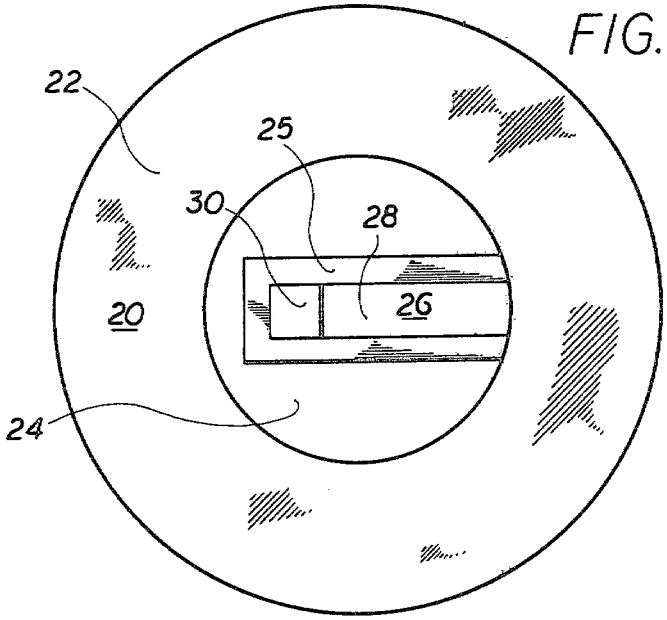

FIGS. 3 and 4 show a base (20) which includes a foot portion (22) having a lower surface (23) and a crown portion (24) having an upper surface (25). Crown portion (24) is provided with a notch or groove (26) having an inclined supporting surface (28) and an end surface (30) that intersects support surface (28) at an angle greater than 90°. The length of support surface (28) is in the range of $\frac{1}{3}$ to 4/5 the length of projectile (10) and, preferably, in the range of $\frac{1}{2}$ to $\frac{3}{4}$ the length of projectile (10). The depth of groove (26) below the upper surface (25) of crown portion (24) is less than $\frac{1}{2}$ the length of groove (26) along upper surface (25).

Preferably, the height of foot portion (22) is greater than the height of crown portion (24). Also preferably, foot portion (22) is hollow and lower surface (23) of foot portion (22) is provided with an aperture (32) and a cap or plug (34) insertable therein.

In playing the game described herein, projectile (10) is first placed in groove (26) such that projectile (10) is supported by inclined surface (28) and one end thereof rests against end surface (30) with the opposite end of projectile (10) exposed. The player then strikes the exposed end of projectile (10) with bat (16). The arrangement of groove (26) and its size in proportion to projectile (10) are such that projectile (10) is launched in a generally upward direction into an area adjacent above base (20). While thus suspended, the player then attempts to again strike projectile (10) with bat (16) in order to drive it in a generally horizontal trajectory.

The structure of base (20), including foot portion (22) and crown portion (24) is such that it provides a stable support from which projectile (10) can be launched. To further increase the stability of base (10), sand, water or other relatively dense material can be added to hollow foot portion (22) through aperture (32) and sealed with plug (34), such that the differential between the mass of base (20) and projectile (10) is greatly increased.

While a presently preferred embodiment of the invention has been shown and described, it is to be understood that the invention is not limited thereto, but may be otherwise variously embodied within the scope of the following claims.

I claim:

1. A game comprising:

a projectile having a length greater than its width;

a bat for striking said projectile; and a base having a crown portion with an upper surface, said crown portion having a groove for supporting said projectile, said groove having a support surface that is inclined with respect to the upper surface and an end surface that forms an obtuse angle with said support surface, the depth of said groove below the upper surface at the intersection of the support surface and the end surface being not more than one-half the length of said groove along the upper surface of the base.

2. A groove as claimed in claim 1 wherein the length of said support surface is in the range of one-third to four-fifths the length of said projectile.

3. A game as claimed in claim 2 wherein the base comprises:

a foot portion.

4. A game as claimed in claim 3 wherein said foot portion is hollow and is further provided with an opening and cap on the bottom surface thereof.

5. A game as claimed in claim 1 wherein:

said base includes a hollow foot portion having a hole in the bottom surface thereof and a cap for plugging said hole.

6. A game as claimed in claims 3 or 5 wherein the height of said crown portion is greater than the height of said foot portion.

7. A game as claimed in claims 2 or 5 wherein said projectile comprises a tubular member having closed ends, the length of said member being at least three times its diameter.

* * * * *